United States Patent [19]

Schweizer et al.

[11] Patent Number: 4,741,837

[45] Date of Patent: May 3, 1988

[54] PROCESS FOR DRYING BROWN COAL OF HIGH WATER CONTENT

[75] Inventors: Michael Schweizer, Trofaiach; Jaroslav Fohl, Leoben; Gero Tessmer, Linz, all of Austria

[73] Assignee: Voest-Alpine Aktiengesellschaft, Linz, Austria

[21] Appl. No.: 927,095

[22] Filed: Nov. 5, 1986

[30] Foreign Application Priority Data

Nov. 8, 1985 [AT] Austria ..... 3260/85

[51] Int. Cl.[4] ..... C02F 1/28

[52] U.S. Cl. ..... 210/665; 34/9; 34/12; 34/36; 44/620; 209/3; 209/5; 209/10; 209/11; 210/667; 210/692; 210/694; 210/710; 210/769; 210/806

[58] Field of Search ..... 210/663, 665, 667, 670, 210/692, 694, 702, 710, 787, 908, 909, 769, 806; 34/36, 9, 12; 209/3, 5, 10, 11; 44/1 G, 2, 100

[56] References Cited

U.S. PATENT DOCUMENTS 3,763,040 10/1973 Timpe et al. ..... 210/667

4,303,531 12/1981 Kawabata et al. ..... 210/909

*Primary Examiner*—Peter Hruskoci

*Attorney, Agent, or Firm*—Cushman, Darby & Cushman

[57] ABSTRACT

For the purpose of increasing the efficiency during drying of brown coals having a high water content and for the purpose of facilitating the purification of process waste water resulting in a drying process according to Fleissner it is proposed to spray hot water onto the raw coal and to separate the proportion in fine grain having a maximum grain size of 5 mm, preferably of 1 mm. In the following, the proportion in fine grain is subjected to an adsorption stage (5), noting that after a reaction time of at least 1 min, preferably of 2 to 5 min, a major portion of the soluble substances burdening the waste water becomes adsorbed on this fine grain. Subsequently, the waste water is further purified after a flocculating step in a flocculating reactor (6) and after a separating step (8) for separating solid matter, for which purpose can be used sand filters (10), adsorbing resins and activated carbon. The separated process water can be used as feed water for a steam production in a combustion plant (13) and be partially used for rinsing the sand filters (10).

11 Claims, 1 Drawing Sheet

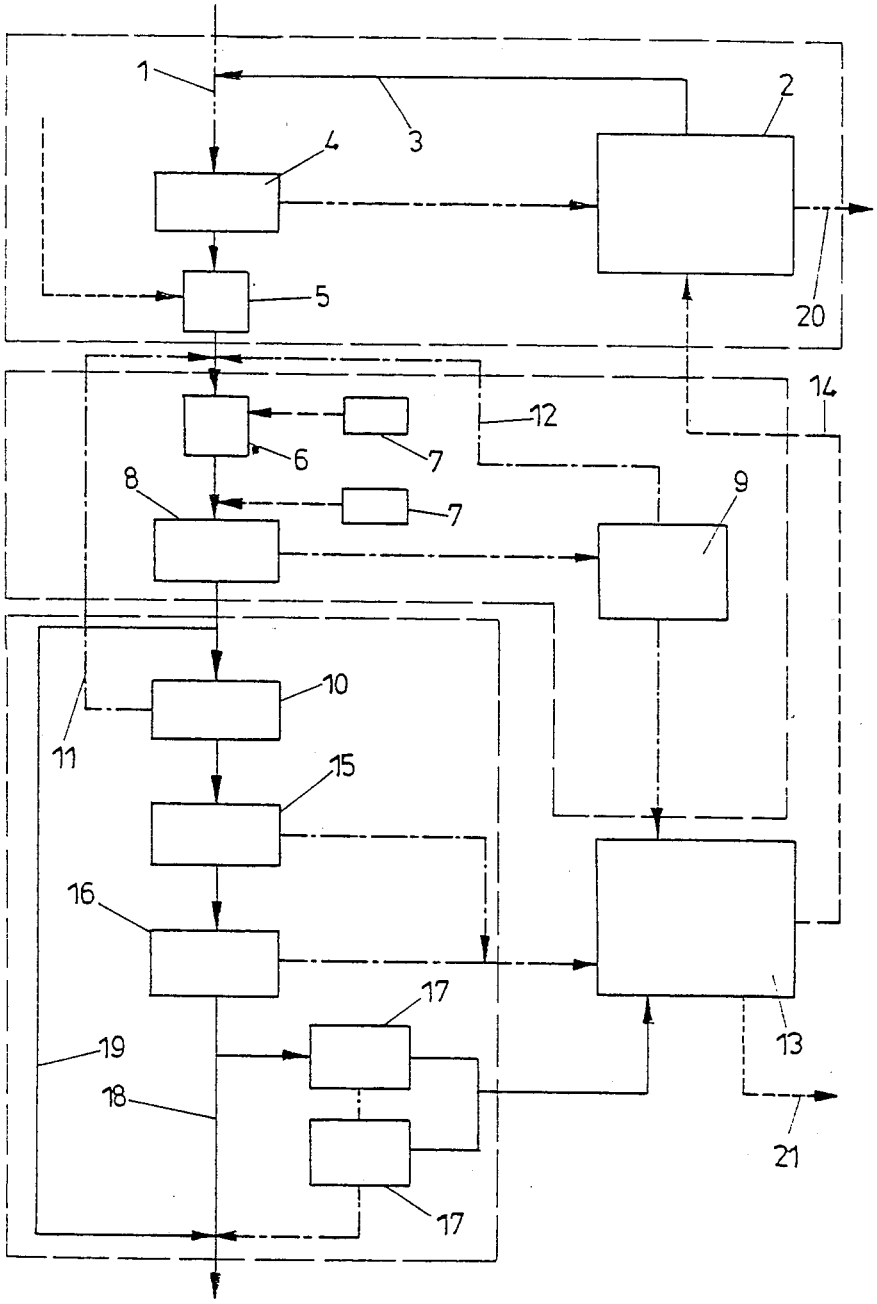
1
2
3
4
5
20
14
12
6
7
8
7
9
10
11
15
16
17
13
19
18
21
17

PROCESS FOR DRYING BROWN COAL OF HIGH WATER CONTENT

BACKGROUND OF THE INVENTION

1. Field of the Invention

The invention refers to a process for drying brown coals having a high water content, in which process the coal to be dried is, prior to a treatment with saturated steam, sieved and fine grain is separated and the sieve refuse having a grain size of smaller than 300 mm is treated with saturated steam and dried.

2. Description of the Prior Art

In a known process accordrng to Fleissner, the brown coal is dried in an atmosphere of saturated steam under pressures of 10 to 40 bar and at temperatures of 180° to 250° C. Per each ton of raw coal, there are obtained 300 to 800 l of partially strongly contaminated water. The obtained amount of water is dependent on the water content of the raw coal and on the desired drying degree of the dry coal. It is already known to use such water obtained from the process for preheating the coal by spraying this water onto the coal. The process water used for being sprayed over the coal itself has a content of solid matter of approximately 5 to 40 g/l, said content in solid matter containing substantially extremely fine grain. The proportion in solid matter contains only approximately 10% of grains having a grain size of more than 50 μm and approximately 50% of the proportion in solid matter has a grain size of smaller than 10 μm. Furthermore, this process water contains humic acids in amounts of 40 to 150 mg/l and phenols in amounts of 5 to 30 mg/l, so that subsequent purification of such process water is relatively expensive.

From U.S. Pat. No. 4,395,334 there has already become known a process of the initially mentioned type, in which is connected in series a previous sieving step of the coal to be dried. Such a sieving step, which is performed without heating and without the supply of water, does not allow to substantially separate adhering grains, and the material supplied to the drying step performed with saturated steam results, on account of the remaining proportions of phenols, humic acids or the like, in further burdening the waste water of the process. Such contaminations are extremely unfavourable for a biological purification of the waste water, as is in correspondence with the known proposal, and detract from the purification effect.

SUMMARY OF THE INVENTION

The present invention now aims at improving the economy of the process and in particular to reduce the expenditure for the purification of the waste water produced in the process and thereby simultaneously to improve the drying degree. For solving this task, the invention essentially consists in that the coal to be dried is, prior to separating fine grain, sprayed with hot water and preheated and in that the separated proportion of fine grain and the hot water are subjected to an separating step, whereupon the solid matter is separated from the liquid phase. On account of the finest grain and the adhering grain being separated, the latter by means of hot water, together with further matter, in particular matter being soluble in hot water, prior to introduction into the drying reactor, drying according to Fleissner can be performed more effectively and more rapidly. On account of said separated finest grain being subjected, in particular within a period of at least 1 minute and preferably within a period of 2 to 5 minutes, to an adsorption step, it becomes possible to perform with this coal grain derived from the drying process a particularly simple and extremely effective adsorption of noxious matter contained in the waste water and to substantially facilitate the subsequent purification of the waste water.

The process according to the invention is in an advantageous manner performed such that fine grain having a maximum grain size of 5 mm, preferably of 1 mm, is separated.

An adsorption step can be effected within a reactor into which are optionally introduced additional adsorption agents. By means of such an adsorption reactor, it is easily possible to directly separate phenols and other organic substances, so that the dissolved proportion of contaminating matter contained in the waste water is reduced. The content of the raw coal in fine grain contributes, on account of its adsorbing properties, to a reduction of the residual contamination. The adsorption effect can be improved by increasing the reaction time, by changing the flow conditions as well as by adding, for example, coal dust.

To subsequently meet the prescribed marginal values for waste water, according to which is prescribed a maximum content of 50 mg/l solid matter, a neutral pH-value and phenols in a maximum amount of 0.1 mg/l, the suspension is, after the adsorption step, subjected to a, preferably plural-stage, flocculation step and, after a separation step for solid matter, introduced into a dewatering stage for the sludge. Separation of solid matter can be performed during the process in simple manner, optionally after a thickening step performed by centrifuging, noting that separation of solid matter may comprise usual thickeners, lamellae thickeners, electrolytic flotation cells or cyclones. For the purpose of increasing the settling speeds when separating solid matter, there can be used as flocculating agents CaO, $Ca(OH)_2$, $FeSO_4$ or polyelectrolytes. The addition of such flocculating agents results in a substantial increase of the settling speed, so that the thickening devices can be made substantially smaller. The concentration in solid matter can in this manner easily be increased above 300 g/l, and the concentrating step can be performed in several stages. Of course, disc filters, drum filters or belt presses can, beside a centrifuging step, be used for separating the solid matter.

The solid matter obtained can subsequently be subjected to a combustion step, in particular for the purpose of producing saturated steam, noting that the calorific value of the solid matter is, in dependence of the type of coal and on the ash content, approximately 1800 to 2500 Kcal/kg.

The waste water remaining after the separation of the solid matter can, in dependence on the requirements, be still purified in further stages, for which purpose the procedure is advantageously such that the liquid phase obtained in the step of separating solid matter is passed over a filter, in particular a sand filter, and the rinsing water is supplied to the flocculation step. Sand filters are, as a rule, operated in combination with back flushing devices for the purpose of separating residual suspended matter and for cleaning the filter. For the purpose of reducing the chemical oxygen demand down to less than 100 mg oxygen per litre, it is adviseably to subsequently perform a purification step by means of adsorbing resins, noting that there follows a treating step by means of activated carbon, which treating step is advantageously used as the final purification step. There can additionally be used with advantage treatments by means of ion-exchangers for the purpose of producing boiler feed water for the drying steam. When using adsorbing resins and/or activated carbon, the eluates of the adsorbing resins and the consumed activated carbon can, together with the dewatered sludge, be supplied to the combustion step for the steam production. The purified water can at least partially be recycled as rinsing water to the sand filter or be supplied to a biological purification step.

As a whole,there results a purification of the waste water of the process which is simple in operation and can be attended without problems, thereby simultaneously improving the energy balance of the process for drying coal.

BRIEF DESCRIPTION OF THE DRAWING

In the drawing, the invention is further explained with reference to an embodiment schematically shown in the drawing.

DETAILED DESCRIPTION OF THE PREFERRED EMBODIMENT

In the drawing, there is diagrammatically shown a plant according to the invention. Raw coal is charged at 1, noting that hot waste water is removed from the drying reactor 2 for the coal via a conduit 3 for being sprayed onto the raw coal for the purpose for preheating same. The sprayed raw coal arrives on a sieve 4 on which proportions of fine grain having a grain size of less than 5 mm, preferably less than 1 mm, are separated, thereby supplying to the coal drying stage 2 only grain proportions having a grain size between 5 and 300 mm or, respectively, 1 and 50 mm. The proportion of fine grain is subsequently supplied into an adsorption reactor 5. Additional adsorption agents such as activated carbon can be supplied to the adsorption reactor 5.

The suspension discharged from the adsorption reactor is supplied to a flocculating reactor 6, into which are dosed flocculating agents from a corresponding dosing means 7. There can again be made an addition of flocculating agents from a corresponding dosing means 7, whereupon the suspension is subjected to a separating step 8 for separating solid matter. The solid matter is then transferred to a sludge dewatering step 9, whereas the liquid phase is fed on top of a sand filter 10. Part of the filtrate flowing out of the sand filter can be used for back flushing the solid matter out of the sand filter 10 and can be recycled to the flocculating reactor 6 via a conduit 11. Likewise, a filtrate coming from the sludge dewatering stage can be recycled to the flocculating reactor 6 via a conduit 12. Subsequently to the sludge dewatering stage, the dewatered sludge enters a combustion stage 13, in which can be produced the steam for the coal drying stage 2. The corresponding steam conduit is designated by 14.

The filtrate coming from the sand filter is subjected to a further purification step by means of adsorbing resins at 15, noting that subsequently a further purification step can be effected by means of activated carbon at 16. The eluates obtained during the regeneration of the adsorbing resins as well as the consumed activated carbon can subsequently equally be burnt in the combustion plant 13, noting that the liquid medium flowing out of the filter of activated carbon can already be considered as being extremely pure. After a further treatment on ion-exchangers, which is schematically indicated by 17, boiler feed water for the production of process steam can be branched off this water. The pure water can already be discharged into a receiving stream via the conduit 18. A partial stream of the purified water obtained behind the separating step 8 for solid matter can be added to the purified water via an annular conduit 19.

The discharge means for dry coal is schematically designated by 20 and the discharge means for discharging ash from the combustion plant is designated by 21.

What is claimed is:

1. In a process for drying brown coal having a high water content, the steps of: spraying the coal with hot water so as to heat the coal and dissolve soluble matter; sieving the sprayed coal to separate a fine solid grain size of a maximum grain size 5 mm plus liquid which contains dissolved matter from solid larger particles of smaller than 300 mm size; drying the thus-separated larger grains by treatment thereof with saturated steam under a pressure of 10 40 bar and a temperature of 180° to 250° C. to produce dry coal and hot waste water; recycling said hot waste water to the spraying step to heat said coal and dissolve said soluble matter; and separating the liquid which contains water and dissolved matter from the fine solids.

2. A process as in claim 1 wherein the sieving step separates fine grains of a maximum grain size of 1 mm.

3. A process as in claim 1 including the step of passing a suspension of the fine grains and the liquid from the sieving step to an adsorption reactor where some of the dissolved matter is absorbed on the fine grains.

4. A process as in claim 3 including subjecting a suspension of solids and liquid from the adsorption reactor to a flocculation step, then carrying out said separating step and then dewatering the solids from said separating step.

5. A process as in claim 3 including filtering the liquid from the separating step and passing at least some of the resulting filtrate to the flocculation reactor.

6. A process in claim 5 wherein filtering is carried out by passing the liquid through a sand filter.

7. A process as in claim 3 including filtering the liquid from the separating step and passing at least some of the resulting filtrate over adsorbing resins.

8. A process as in claim 1 including adding an additional solid adsorbing agent to the adsorption reactor.

9. A process as in claim 1 wherein said separating step is carried out after a thickening step performed by centrifuging.

10. A process as in claim 1 including a combustion step wherein solids from the separating step are burned to produce heat for generating steam.

11. In a process for drying brown coal, which has a high water content and which inherently contains water soluble organic material, the steps of: spraying the coal with hot water so as to heat the coal and dissolve soluble organic material from the coal; separating the sprayed coal into a first portion containing fine coal particles of a maximum grain size of 5 mm and liquid and a second portion containing larger coal particles of smaller than 300 mm; drying the larger particles by treatment thereof with saturated steam under a pressure of 10–40 bar and a temperature of 180° to 250° C. to produce dry coal and hot waste water; recycling said hot waste water to the spraying step to heat said coal and dissolve said organic material; treating said liquid to remove dissolved organic material therefrom; separating the fine solids from said liquid; burning said fine solids and removed organic material in a combustion step whereby the removed organic material need not be discharged to waste; and generating steam for said drying step with heat produced in said combustion step.

* * * * *